US008231348B2

(12) United States Patent
Torii et al.

(10) Patent No.: US 8,231,348 B2
(45) Date of Patent: Jul. 31, 2012

(54) PLATFORM COOLING STRUCTURE FOR GAS TURBINE MOVING BLADE

(75) Inventors: Shunsuke Torii, Hyogo (JP); Masamitsu Kuwabara, Hyogo (JP); Eisaku Ito, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 504 days.

(21) Appl. No.: 12/304,833

(22) PCT Filed: Nov. 27, 2007

(86) PCT No.: PCT/JP2007/073287
§ 371 (c)(1), (2), (4) Date: Dec. 15, 2008

(87) PCT Pub. No.: WO2008/102497
PCT Pub. Date: Aug. 28, 2008

(65) Prior Publication Data

US 2009/0202339 A1 Aug. 13, 2009

(30) Foreign Application Priority Data

Feb. 21, 2007 (JP) ..... 2007-041489

(51) Int. Cl.
*F01D 5/18* (2006.01)

(52) U.S. Cl. ..... 416/97 R; 415/115; 415/116; 415/95; 415/96 R

(58) Field of Classification Search ..... 415/115, 415/116; 416/95, 96 R, 97 R
See application file for complete search history.

(56) References Cited

U.S. PATENT DOCUMENTS 5,382,135 A 1/1995 Green
(Continued)

FOREIGN PATENT DOCUMENTS

GB 742288 A 12/1955
(Continued)

OTHER PUBLICATIONS

International Search Report of PCT/JP2007/073287, Mailing Date of Jan. 15, 2008.

(Continued)

*Primary Examiner* — Asok Sarkar
(74) *Attorney, Agent, or Firm* — Westerman, Hattori, Daniels & Adrian, LLP

(57) ABSTRACT

A platform cooling structure for a gas turbine moving blade is provided which is capable of improving cooling performance of a platform and of improving reliability of a moving blade in such a manner that a portion in the vicinity of a side edge of the platform which is away from moving blade cooling passageways and is easily influenced by thermal stress caused by high-temperature combustion gas, that is, an upper surface of the side edge is effectively cooled by guiding high-pressure cooling air, flowing to the moving blade cooling passageways, to a discharge opening formed in a surface of the platform in the vicinity of the side edge of the platform without particularly attaching an additional member such as a cover plate to the platform. A moving blade cooling passageway 17*c* is formed in the inside of the gas turbine moving blade. Cooling communication holes 24*a* and 24*b*, of which one ends communicate with the moving blade cooling passageway 17*c* and the other ends communicate with a plurality of discharge openings 22 provided in the surface of the platform in the vicinity of the side edge of the platform 5, are formed through the inside of the platform.

6 Claims, 7 Drawing Sheets

(a)

U.S. PATENT DOCUMENTS

| | | | | |
|---|---|---|---|---|
| 6,071,075 | A | 6/2000 | Tomita et al. | |
| 6,190,130 | B1 | 2/2001 | Fukue et al. | |
| 6,196,799 | B1 * | 3/2001 | Fukue et al. | 416/97 R |
| 7,131,817 | B2 | 11/2006 | Keith et al. | |
| 2006/0153681 | A1 | 7/2006 | Lee et al. | |
| 2006/0269409 | A1 | 11/2006 | Torii et al. | |
| 2007/0020100 | A1 | 1/2007 | Beeck et al. | |

FOREIGN PATENT DOCUMENTS

| | | | |
|---|---|---|---|
| GB | 742288 | A1 | 12/1955 |
| JP | 7189604 | A | 7/1995 |
| JP | 8170501 | A | 7/1996 |
| JP | 10-238302 | A | 9/1998 |
| JP | 11-022411 | A | 1/1999 |
| JP | 11-247609 | A | 9/1999 |
| JP | 2000-220404 | A | 8/2000 |
| JP | 2000-230401 | A | 8/2000 |
| JP | 2002-201906 | A | 7/2002 |
| JP | 2006-046339 | A | 2/2006 |
| JP | 2006-329183 | A | 12/2006 |
| WO | 94/12765 | A1 | 6/1994 |

OTHER PUBLICATIONS

Japanese Office Action dated Nov. 11, 2010, issued in corresponding Japanese Patent Application No. 2007-041489.

Chinese Office Action dated Dec. 9, 2010, issued in corresponding Chinese Patent Application No. 200780023118.4.

Korean Office Action dated Sep. 27, 2010, issued in corresponding Korean Patent Application No. 2008-7030978.

Japanese Office Action dated Jun. 3, 2011, issued in corresponding Japanese Patent Application No. 2007-041489.

Japanese Office Action dated Dec. 2, 2011, issued in corresponding Japanese Patent Application No. 2007-041489.

* cited by examiner (a)

(b)

(a)

(b)

(c)

(a)

(b)

PLATFORM COOLING STRUCTURE FOR GAS TURBINE MOVING BLADE

TECHNICAL FIELD

The present invention relates to a platform cooling structure for a gas turbine moving blade.

BACKGROUND ART

An outline structure of a gas turbine moving blade is shown in FIG. 4. In this drawing, the gas turbine moving blade 1 includes a blade part 3 forming a blade, a platform 5 connected to a bottom of the blade part 3, and a shank part 7 located below the platform 5, where a blade root part 9 is formed below the shank part 7.

Then, in FIG. 4, a continuous groove having a wave shape is formed in both side walls of the blade root part 9. A continuous groove having the same shape is formed in a rotor disk 11. By allowing the groove of the blade root part 9 to engage with the groove of the rotor disk 11, the gas turbine moving blade 1 is fixed to the rotor disk 11. Then, in the same fixing manner, a plurality of gas turbine moving blades 1 is adjacently fixed to the rotor disk 11 in a circumferential direction.

Additionally, a cavity 13 is formed by a lower surface of the platform 5 and a side surface of the shank part 7 of the gas turbine moving blade 1, and sealing air is supplied from the rotor to the cavity 13, thereby preventing high-temperature combustion gas from leaking from a gap 15 between the adjacent platforms 5 and 5 by the use of the sealing air.

In the structure of the gas turbine moving blade 1 having the above-described configuration, since the blade part 3 is exposed to the high-temperature combustion gas, at least one moving blade cooling passageway 17 is provided in the inside of the blade part 3 in order to cool the blade part 3, and the moving blade cooling passageways 17 introduces cooling air from the blade root part 9. Although it is not shown in the drawing, a part or a whole part of the passageway communicates with each other so as to form a serpentine cooling passageway and to cool the whole part of the blade part 3.

Additionally, a part of the cooling air introduced into the moving blade cooling passageways 17 is discharged from the trailing edge of the blade part 3 so as to further cool the trailing edge of the blade part 3.

Since the cooling air supplied to the moving blade cooling passageways 17 is used to cool the blade part 3, the cooling air is controlled at a high-pressure different from the sealing air, and is cooled before supplying if necessary.

Additionally, since the surface of the platform 5 is exposed to high-temperature combustion gas, in order to prevent a thermal damage and a crack caused by thermal stress, there are proposed various structures for cooling the platform 5.

For example, a platform 010 of a gas turbine moving blade disclosed in Patent Document 1 (Japanese Patent Application Laid-Open No. H10-238302) is shown in FIG. 5. FIG. 5(a) is a longitudinal sectional view showing the gas turbine moving blade and FIG. 5(b) is a sectional view taken along the line E-E shown in FIG. 5(a). Patent Document 1 discloses a technique for cooling an upper surface of the platform 010 by the use of sealing air 012 flowing to a lower surface of the platform 010. A plurality of sealing air passageway holes 015 is perforated in the inside of the platform 010 on a concave side 013 so as to be formed through the platform 010 in a radial direction relatively from a center of a turbine shaft.

Additionally, a convection cooling hole 017 relatively extends in an oblique manner from the center of the turbine shaft in a radial direction so as to be opened at the upper surface of the platform 010. The opening formed in the upper surface of the platform 010 is provided with a shaped film discharge hole of which an end is widened so as to cool the upper surface of the platform 010 by the cooling air flowing and extending on the upper surface of the platform 010 crawlingly.

Then, a structure for improving a cooling performance of a gas turbine moving blade disclosed in Patent Document 2 (Japanese Patent Application Laid-Open No. H11-247609) is shown in FIG. 6. FIG. 6(a) is a top view showing the gas turbine moving blade and FIG. 6(b) is a sectional view taken along the line F-F shown in FIG. 6(a). Patent Document 2 discloses a cooling passageway 026 which is formed through the inside of a platform 020 so that one ends communicate with a cooling passageway 024 for cooling the inside of the moving blade 022 and the other ends are opened at both end surfaces of the platform 020.

Further, as shown in FIG. 7, Patent Document 3 (Japanese Patent Application Laid-Open No. 2006-329183) discloses a structure for cooling a portion in the vicinity of a front end of a platform 052 in such a manner that a cover plate 050 is attached between a lower surface of a platform 052 and a shank 054 so as to form a space 056 by the cover plate 050, high-pressure cooling air is guided from a cooling passageway 058 for cooling the inside of a moving blade to the space 056 via a passageway 059, and then the high-pressure cooling air is supplied to the surface of the platform 052 via the space 056 and cooling holes 061 and 063.

As described above, various techniques for cooling the platform of the gas turbine moving blade have been proposed. Patent Document 1 discloses the structure for cooling the platform 010 by the use of the sealing air 012. However, since the sealing air is supplied from the lower surface of the platform in order to prevent the high-temperature combustion gas from leaking from a gap between the adjacent platforms to the rotor, in general, a temperature of the sealing air is not controlled and moreover, a pressure of the sealing air is not controlled at high pressure. As a result, it is not possible to obtain the sufficient cooling performance just by cooling the platform by the use of the sealing air.

Particularly, since a portion in the vicinity of the side edge of the platform away from the bottom of the blade is away from the moving blade cooling passageway 019 for cooling the inside of the blade, it is difficult to cool the portion. Due to such a thermal condition, a cooling structure is required which is capable of effectively cooling the portion in the vicinity of the side edge of the platform away from the bottom of the blade, that is, the surface exposed to the high-temperature combustion gas.

Meanwhile, Patent Documents 2 and 3 disclose the structure for cooling the platform by the use of the high-pressure cooling air flowing to the moving blade cooling passageway instead of the sealing air.

However, in Patent Document 2, the cooling air is discharged from the cooling passageway 026, which is formed through the inside of the platform 020 so that one ends communicate with the cooling passageway 024 for cooling the inside of the moving blade 022 and the other ends are opened at both end surfaces of the platform 020, to the end surfaces of the platform 020, that is, the gap between the adjacent platforms. For this reason, it is possible to cool and seal the end surface of the platform 020, but a problem arises in that it is not possible to effectively cool the upper surface of the platform in the vicinity of the side end portion exposed to the high-temperature combustion gas.

Then, in Patent Document 3, the cooling air flowing to the moving blade cooling passageway is guided from the side end portion of the platform to the upper surface of the platform. However, since the space is formed by attaching the cover plate between the shank and the lower surface of the platform, and the cooling air is discharged to the surface in the vicinity of the front end portion via the space, it is necessary to fix the cover plate to the platform and the shank by welding or the like. As a result, a problem arises in that the processes of assembling increase. Also, since the moving blade rotating at a high speed needs to have higher reliability than that of a stationary member, it is necessary to remove an additional member such as the cover plate as much as possible in general.

DISCLOSURE OF THE INVENTION

Therefore, the present invention is contrived in consideration of the above-described background, and an object of the invention is to provide a platform cooling structure for a gas turbine moving blade is provided which is capable of improving cooling performance of a platform and of improving reliability of a moving blade in such a manner that a portion in the vicinity of a side edge of the platform which is away from moving blade cooling passageways and is easily influenced by thermal stress caused by high-temperature combustion gas, that is, an upper surface of the side edge is effectively cooled by guiding high-pressure cooling air, flowing to the moving blade cooling passageways, to a discharge opening formed in a surface of the platform in the vicinity of the side edge of the platform without particularly attaching an additional member such as a cover plate to the platform.

In order to achieve the above-described object, according to an aspect of the invention, there is provided a platform cooling structure for a gas turbine moving blade including: at least one moving blade cooling passageway formed in the inside of a blade part of a gas turbine moving blade so as to circulate cooling air; and cooling communication holes each of which having one end thereof communicates with the moving blade cooling passageways and the other end communicates with a plurality of discharge openings formed in a surface of a platform in the vicinity of a side edge of the platform, wherein the cooling communication holes are formed through from the moving blade cooling passageways to the inside of the platform or formed through the inside of a shank part and the platform.

According to the invention, since each of the cooling communication holes of which one end communicates with the moving blade cooling passageways and another end communicates with the plurality of discharge openings formed in the surface of the platform in the vicinity of the side edge of the platform is formed through from the moving blade cooling passageways to the inside of the platform or formed through the inside of the shank part and the platform, it is possible to guide high-pressure cooling air, flowing to the moving blade cooling passageways, to the surface in the vicinity of the side edge of the platform without particularly attaching an additional member to the platform.

As a result, since a portion in the vicinity of the side edge of the platform which is easily influenced by thermal stress caused by the high-temperature combustion gas, that is, the upper surface of the side edge is cooled effectively, it is possible to improve cooling performance of the platform. Also, since the additional member such as a cover plate is not attached to the moving blade rotating at a high speed, it is possible to improve reliability of the moving blade.

Preferably, each of the cooling communication holes may include a platform passageway formed in a liner shape in such a way that one end of the platform passageway on a side portion of a moving blade in the platform communicates with the moving blade cooling passageways and another end communicates with a side end surface of the platform with an opening of the side end surface closed, and one or more discharging passageways formed inclined from the platform passageway toward the discharge opening.

According to the invention, since the platform passageway forming the cooling communication hole is formed so that one end communicates with the moving blade cooling passageways and the other end communicates with the side end surface of the platform in a linear shape by closing the opening of the side end surface, the platform passageway is formed by machining after forming the platform and the blade part by casting, and the discharging passageway is formed by machining so as to intersect the platform passageway in an inclined direction, thereby forming the cooling communication hole.

Preferably, the moving blade cooling passageways of the shank part may be swollen in a direction toward the side edge of the platform; and the cooling communication holes may be formed through the inside of the platform and the shank part in a linear shape.

According to the invention, since the shank part is swollen toward the side edge of the platform, it is possible to form the cooling communication hole formed through the inside of the platform and the shank part from the swollen part.

As a result, since it is possible to form the cooling communication hole up to a portion of the platform away from the moving blade cooling passageways without particularly attaching an additional member such as a cover plate to the platform, it is possible to guide the high-pressure cooling air, flowing to the moving blade cooling passageways, to the upper surface of the side edge and to improve the reliability of the moving blade.

Preferably, an projecting part may be formed at a portion where a lower surface of the platform intersects an outer surface of the shank part; and the cooling communication holes may be formed through the inside of the shank part, the platform, and the projecting part. According to the invention, since it is possible to form the cooling communication hole up to a portion of the platform away from the moving blade cooling passageways without particularly attaching the additional member such as the cover plate to the platform, it is possible to guide the high-pressure cooling air, flowing to the moving blade cooling passageways, to the upper surface of the side edge and to improve the reliability of the moving blade.

Further, the projecting part having the cooling communication holes formed therein may protrude in a convex shape; and the projecting part and the cooling communication hole may be formed upon forming the platform and the shank part by casting. Accordingly, since the projecting part is formed in only a portion where the cooling communication hole is provided, it is possible to realize a decrease in weight of the projecting part and to manufacture the cooling communication hole in a simple manner.

Further, in the platform cooling structure for the gas turbine moving blade with the above-described configuration, a plurality of rows of the discharge openings may be formed in an upper surface in the vicinity of the side edge of the platform so as to be disposed along the side edge. According to the invention, since the discharge opening is broadly provided in the upper surface in the vicinity of the side edge of the platform, the surface in the vicinity of the front end of the platform is effectively cooled by the high-pressure cooling air flowing to the moving blade cooling passageways, thereby obtaining the higher cooling performance and cooling the broader area.

As described above, according to the invention, it is possible to obtain the platform cooling structure for the gas turbine moving blade capable of improving the cooling performance of the platform and of improving the reliability of the moving blade in such a manner that a portion in the vicinity of the side edge of the platform which is away from the moving blade cooling passageways and is easily influenced by the thermal stress caused by the high-temperature combustion gas, that is, the upper surface of the side edge is effectively cooled by guiding the high-pressure cooling air, flowing to the moving blade cooling passageways, to the discharge opening formed in a surface of the platform in the vicinity of the side edge of the platform without particularly attaching the additional member such as the cover plate described in Patent Document 3 to the platform.

BEST MODE FOR CARRYING OUT THE INVENTION

Hereinafter, exemplary embodiments of the invention will be described in detail with reference to the accompanying drawings. Here, although the dimension, the material, the shape, the relative arrangement, and the like of the component are described in the embodiment, the scope of the invention is not limited thereto so long as a particular description is not made, but those are only examples for a description.

The embodiments of the invention will be described in detail with reference to the appropriate drawings.

Figure 1:
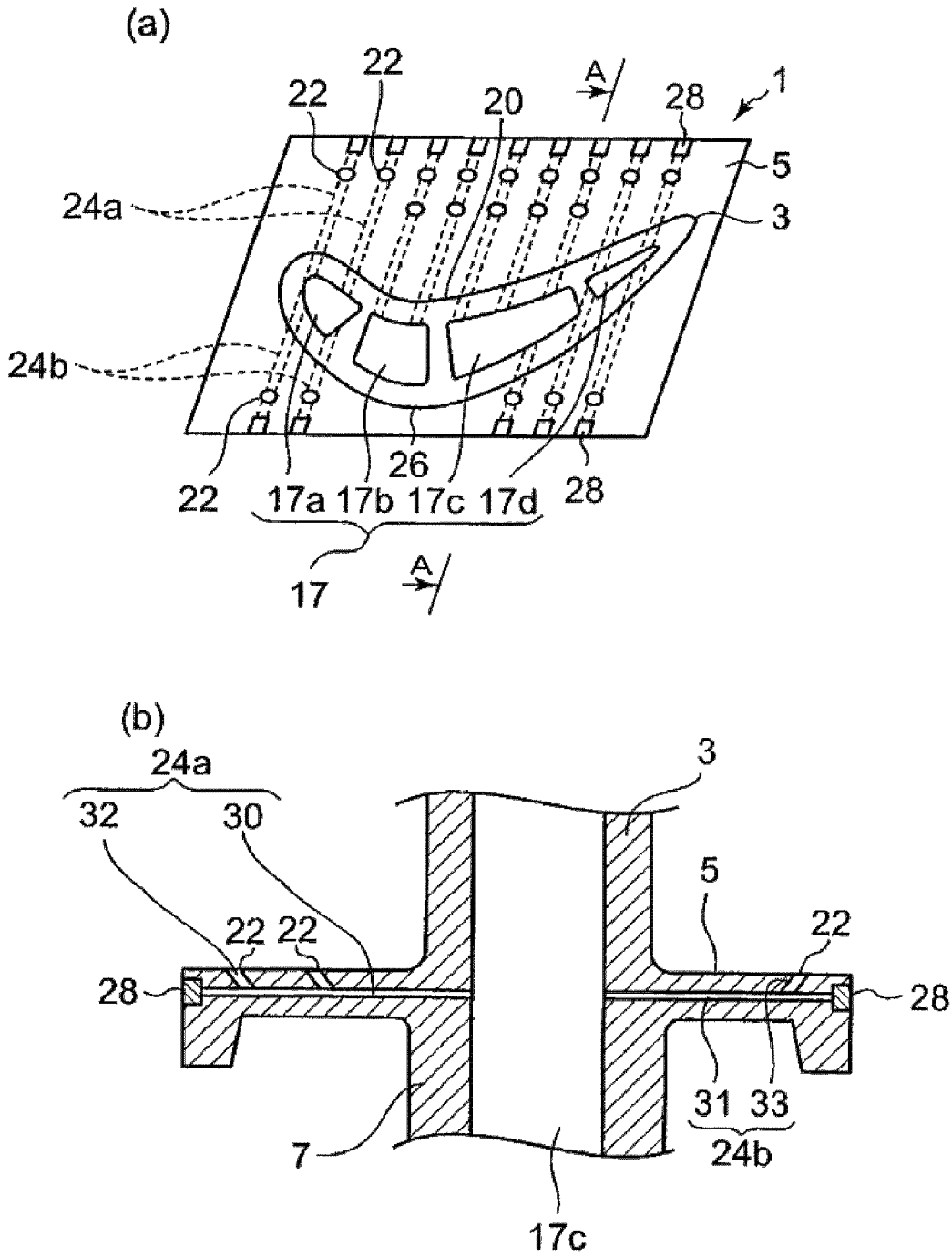
FIG. 1 shows a platform cooling structure for a gas turbine moving blade according to a first embodiment of the invention, where FIG. 1(*a*) is a top view showing a platform of the gas turbine moving blade and FIG. 1(*b*) is a sectional view taken along the line A-A shown in FIG. 1(*a*).
Figure 2:
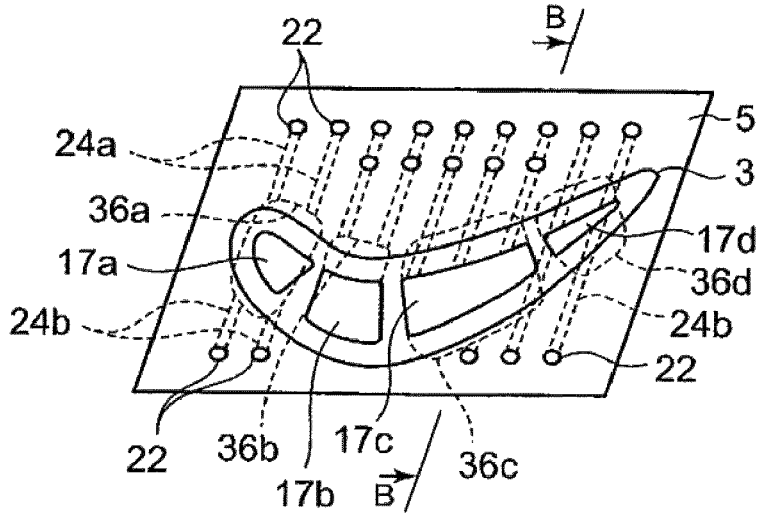
FIG. 2 shows a second embodiment, where FIG. 2(*a*) is a top view showing the platform of the gas turbine moving blade and FIG. 2(*b*) is a sectional view taken along the line B-B shown in FIG. 2(*a*).
Figure 2:
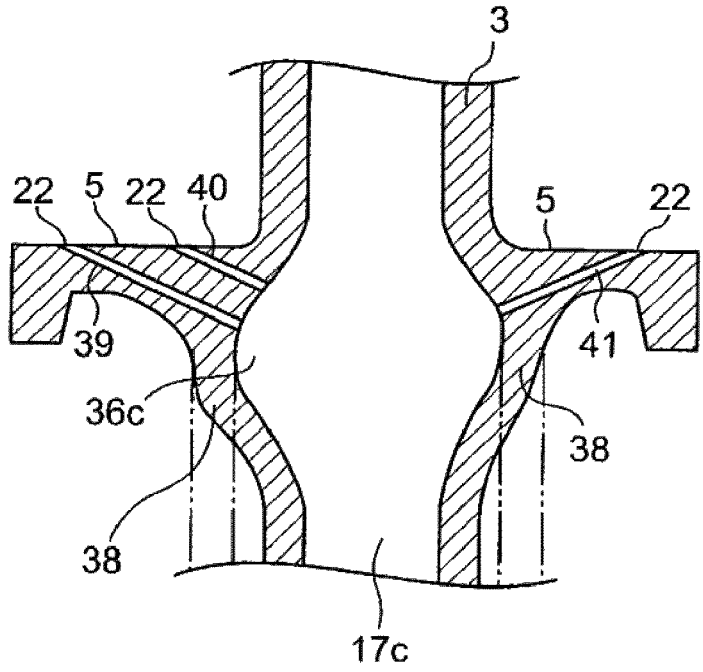
Figure 3:
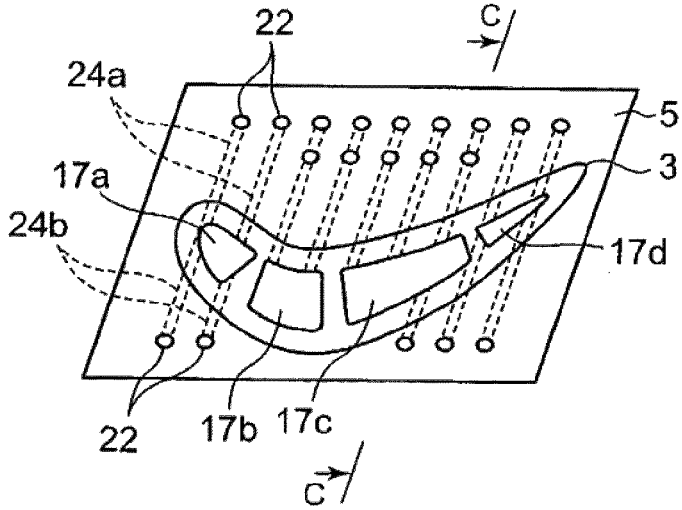
FIG. 3 shows a third embodiment, where FIG. 3(*a*) is a top view showing the platform of the gas turbine moving blade, FIG. 3(*b*) is a sectional view taken along the line C-C shown in FIG. 3(*a*), and FIG. 3(*c*) is a sectional view taken along the line D-D shown in FIG. 3(*b*).
Figure 3:
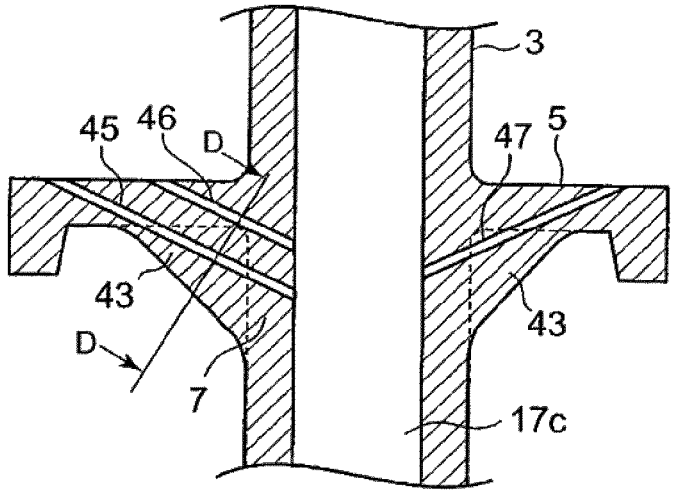
Figure 3:
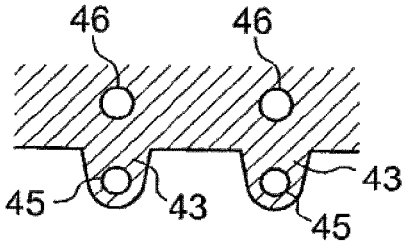

In the referred drawings, FIG. 1 shows a platform cooling structure for a gas turbine moving blade according to a first embodiment of the invention, where FIG. 1(*a*) is a top view showing a platform of the gas turbine moving blade and FIG. 1(*b*) is a sectional view taken along the line A-A shown in FIG. 1(*a*). FIG. 2 shows a second embodiment, where FIG. 2(*a*) is a top view showing the platform of the gas turbine moving blade and FIG. 2(*b*) is a sectional view taken along the line B-B shown in FIG. 2(*a*). FIG. 3 shows a third embodiment, where FIG. 3(*a*) is a top view showing the platform of the gas turbine moving blade, FIG. 3(*b*) is a sectional view taken along the line C-C shown in FIG. 3(*a*), and FIG. 3(*c*) is a sectional view taken along the line D-D shown in FIG. 3(*b*).

Figure 4:
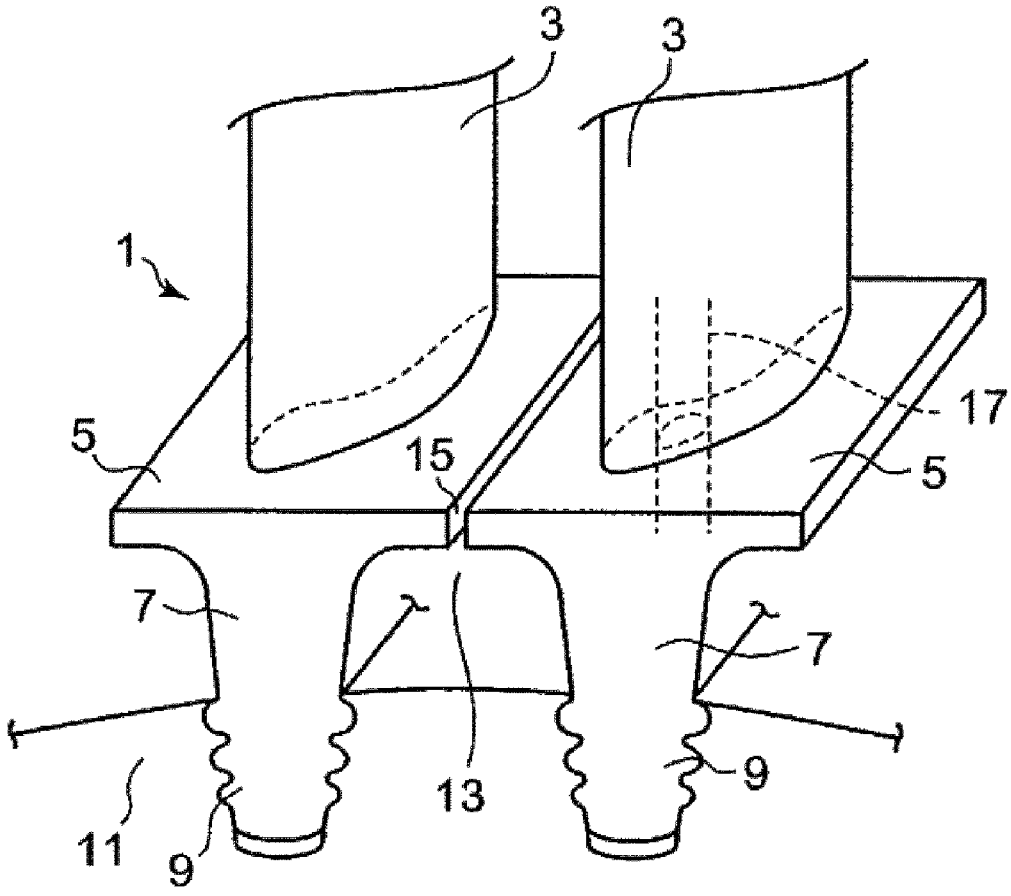
FIG. 4 is a perspective view showing an outline structure of the gas turbine moving blade.
Figure 5:
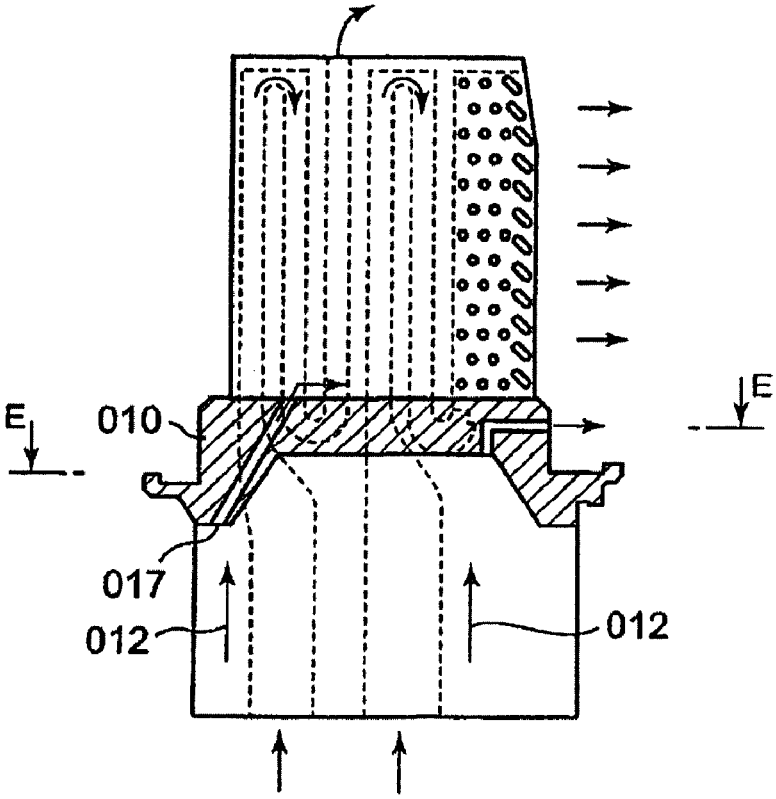
Fig.5 Prior Art
FIG. 5 is an explanatory view showing a conventional art.
Figure 5:
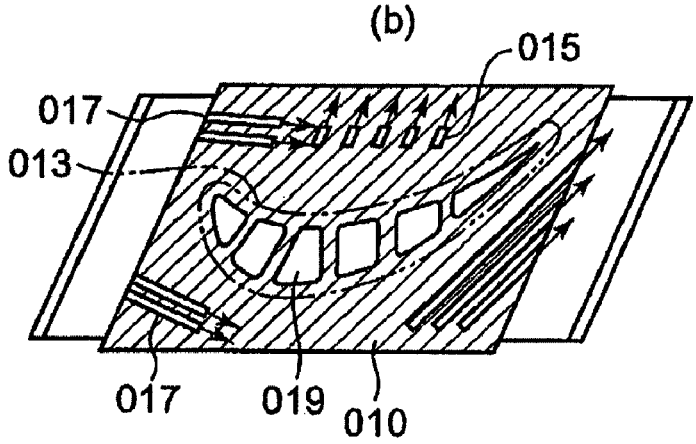
Fig.5 Prior Art
Figure 6:
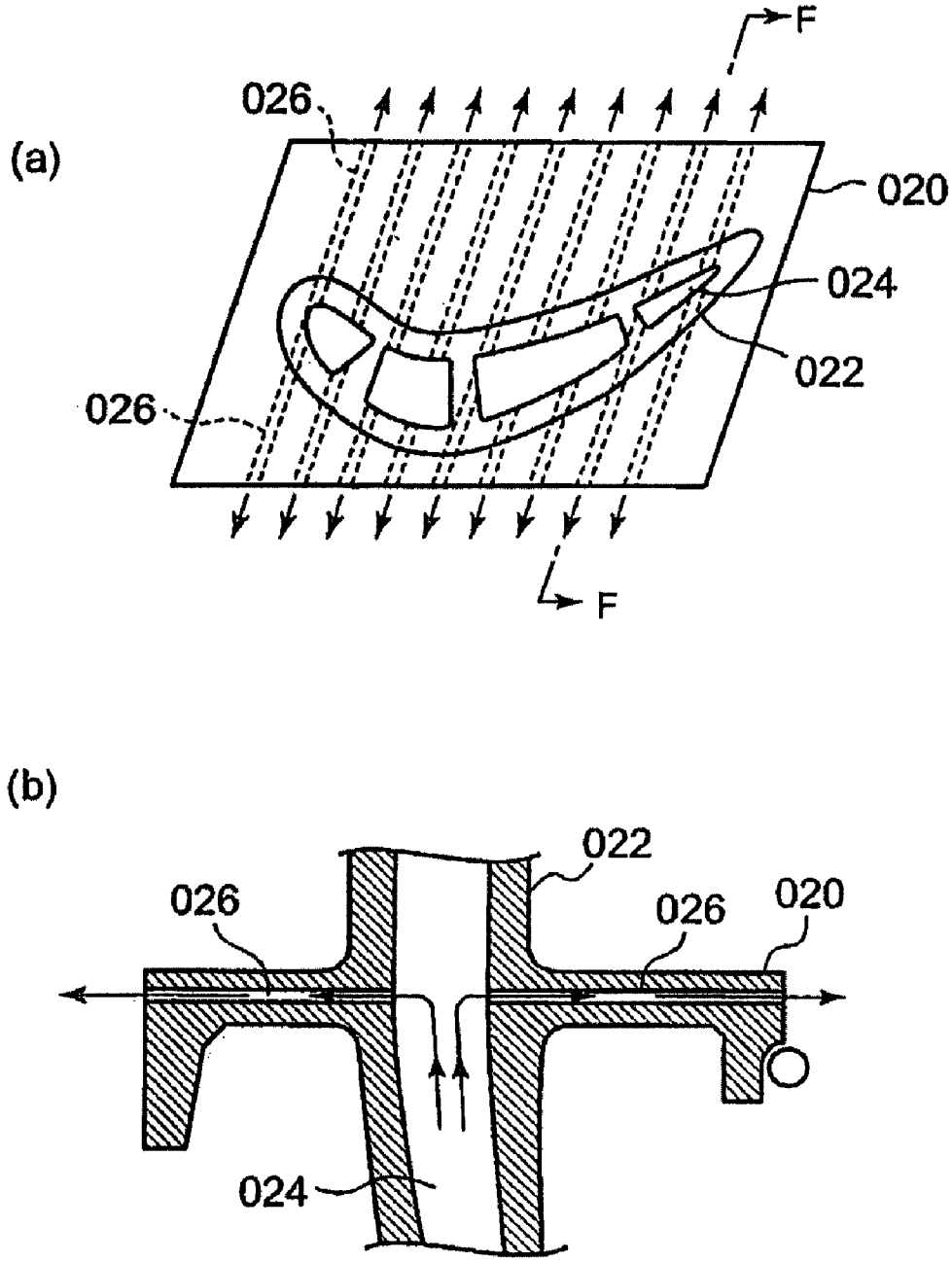
Fig.6 Prior Art
FIG. 6 is an explanatory view showing a conventional art.
Figure 7:
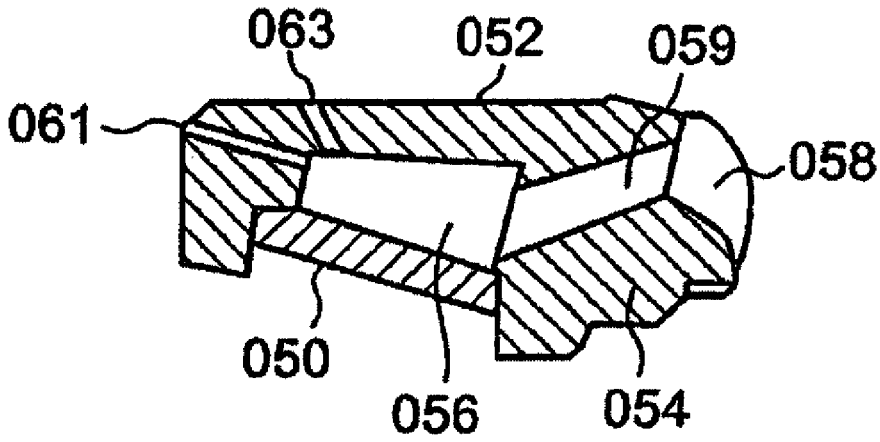
Fig.7 Prior Art
FIG. 7 is an explanatory view showing a conventional art.

FIG. 4 shows an outline structure of a gas turbine moving blade 1. In this drawing, the gas turbine moving blade 1 includes a blade part 3 forming a blade, a platform 5 connected to a bottom of the blade part 3, and a shank part 7 located below the platform 5, where a blade root part 9 is formed below the shank part 7.

Then, in FIG. 4, a continuous groove having a wave shape is formed in both side walls of the blade root part 9. A continuous groove having the same shape is formed in a rotor disk 11. By allowing the groove of the blade root part 9 to engage with the groove of the rotor disk 11, the gas turbine moving blade 1 is fixed to the rotor disk 11. Then, in the same fixing manner, a plurality of gas turbine moving blades 1 is adjacently fixed to the rotor disk 11 in a circumferential direction.

Additionally, a cavity 13 is formed by a lower surface of the platform 5 and a side surface of the shank part 7 of the gas turbine moving blade 1, and sealing air is supplied from the rotor to the cavity 13, thereby preventing high-temperature combustion gas from leaking from a gap 15 formed between the adjacent platforms 5 and 5 by the use of the sealing air.

In the structure of the gas turbine moving blade 1 having the above-described configuration, since the blade part 3 is exposed to the high-temperature combustion gas, at least one moving blade cooling passageway 17 is provided in order to cool the blade part 3, and the moving blade cooling passageways 17 introduce cooling air from the blade root part 9. Although it is not shown in the drawing, a part or a whole part of the passageway communicates with each other in the blade so as to form a serpentine cooling passageway and to cool the whole part of the blade part 3.

Additionally, a part of the cooling air introduced into the moving blade cooling passageways 17 is discharged from the trailing edge of the blade part 3 so as to further cool the trailing edge of the blade part 3.

Since the cooling air supplied to the moving blade cooling passageways 17 is used to cool the blade part 3, the cooling air is controlled at a high-pressure different from the sealing air, and is cooled before supplying if necessary.

The structure of the gas turbine moving blade is the same as that of the background art. Next, a structure for cooling the platform 5 according to the invention will be described with reference to FIGS. 1 to 3.

First Embodiment

As shown in FIG. 1, the platform 5 is formed in a substantially rectangular shape in a top view. The blade part 3 is integrally formed with the platform 5 by casting. In the inside of the blade part 3, the moving blade cooling passageways 17 are provided as a leading edge portion 17*a*, center portions 17*b*, 17*c*, and a trailing edge portion 17*d*. Then, cooling air is introduced from the blade root part 9 into the passageways. Although it is not shown in the drawing, a part or a whole part of the passageways communicate with one another in the inside of the blade so as to form a serpentine cooling passageway and to cool the whole part of the blade part 3.

In a surface of the platform 5 in the vicinity of the side edge on a concave side 20 of the platform 5, a plurality of cooling air discharge openings 22 is provided along the side edge, and a cooling communication hole 24*a* is provided of which one end communicates with the moving blade cooling passageways 17*a*, 17*b*, 17*c*, or 17*d* and the other end communicates with the cooling air discharge opening 22. As shown in FIG. 1, a plurality of cooling communication holes 24*a* on the concave side 20 of the blade part 3 is arranged so as to be substantially parallel to the leading edge of the platform 5. On a convex side 26, two cooling communication holes 24*b* are provided on the leading edge of the blade part 3 and three cooling communication holes 24*b* are provided on the trailing edge thereof so as to be substantially parallel to the leading edge of the platform 5, respectively. Additionally, the cooling communication holes 24*a* and 24*b* may be arranged at an appropriate angle therebetween so as to optimize the cooling state of the platform.

Then, as shown in FIG. 1(*b*), in the inside of the platform 5, each cooling communication hole 24*a* on the concave side 20 is formed in a linear shape so that one end communicates with the moving blade cooling passageway 17*c* and the other end communicates with the side end surface of the platform 5. A platform passageway 30 is formed in such a manner that the opening of the side end surface is closed by a plug 28, and a discharging passageway 32 is formed so as to be inclined from the platform passageway 30 toward the discharge opening 22. Two rows of discharge openings 22 are provided along the side edge so as to broadly cool the surface in the vicinity of the side edge of the platform 5.

Additionally, in the same manner, in the cooling communication holes 24*b* on the convex side 26, a platform passageway 31 is formed in such a manner that the opening of the side end surface is closed by the plug 28, and a discharging passageway 33 is formed so as to be inclined from the platform passageway 31 toward the discharge opening 22.

The platform passageway 30 on the concave side 20 and the platform passageway 31 on the convex side 26 are formed in a linear shape in a direction opposite to each other, respectively. Additionally, since the discharging passageways 32 and 33 are inclined toward the side end portion of the platform 5, it is possible to broadly cool the surface of the platform 5.

According to the first embodiment, one ends of the platform passageways 30 and 31 communicate with the moving blade cooling passageways 17*a*, 17*b*, 17*c*, or 17*d*, and the other ends thereof communicate with the side end surface of the platform 5 so as to be formed in a linear shape by closing the opening of the side end surface. Accordingly, it is possible to form the platform passageways 30 and 31 after or at the same time the platform 5 and the blade part 3 are integrally formed by casting.

Then, it is possible to form the cooling communication holes 24*a* and 24*b* in such a manner that the discharging passageways 32 and 33 are formed by machining so as to intersect the platform passageways 30 and 31 in an inclined direction.

Additionally, since the cooling communication passageways 24*a* and 24*b* are formed through the inside of the platform 5 and the moving blade cooling passageways 17, it is possible to guide high-pressure cooling air, flowing to the moving blade cooling passageways, to the surface in the vicinity of the side edge of the platform 5 without particularly attaching an additional member such as a cover plate to the platform 5.

As a result, since a portion in the vicinity of the side edge of the platform 5 which is away from the moving blade cooling passageways 17 and is easily influenced by thermal stress caused by the high-temperature combustion gas, that is, the upper surface of the side edge is effectively cooled, it is possible to improve the cooling performance of the platform 5. Also, since the additional member is not attached to the gas turbine moving blade 1 which rotates at a high speed, it is possible to improve reliability of the moving blade. Further, since the welding process of the additional member is not carried out, the processes of assembling do not increase, thereby improving the workability of assembling.

Second Embodiment

Next, a second embodiment will be described with reference to FIG. 2.

The same reference numerals are given to the same components as those of the first embodiment, and the description thereof will be omitted. In the second embodiment, cooling passageway swollen parts 36*a*, 36*b*, 36*c*, and 36*d* are formed in such a manner that the moving blade cooling passageways 17*a*, 17*b*, 17*c*, and 17*d* of the shank part 7 are swollen toward the side edge of the platform 5.

Since the cooling passageway swollen parts 36*a*, 36*b*, 36*c*, and 36*d* are formed as shown in FIG. 2(*b*), the shank part 7 is swollen outward, and cooling communication holes 39, 40, and 41 are formed through the inside of the platform 5 and a swollen shank part 38 in a linear shape.

The platform 5 on the concave side 20 is provided with the outer cooling communication hole 39 and the inner cooling communication hole 40, and the platform 5 on the convex side 26 is provided with the cooling communication hole 41.

Additionally, the cooling communication holes 39, 40, and 41 may be integrally formed upon forming the blade part 3 and the platform 5 by casting or may be formed by machining after casting.

Each of the cooling passageway swollen parts 36*a*, 36*b*, 36*c*, and 36*d* may have an inner diameter swollen to the blade root part 9 (see FIG. 4) as shown by the chain line of FIG. 2(*b*).

According to the second embodiment, in the swollen shank part 38 and the platform 5, it is possible to form the cooling communication holes 39, 40, and 41 passing through the inside of the platform 5 and the swollen shank part 38 in a linear shape. As a result of the cooling communication holes 39, 40, and 41, it is possible to cool the side edge of the platform 5 positioned away from the moving blade cooling passageways 17 by guiding the high-pressure cooling air, flowing to the moving blade cooling passageways, to the portion in the vicinity of the side edge of the platform 5, that is, the upper surface of the side edge without particularly attaching the additional member such as the cover plate to the platform 5.

Additionally, the cooling communication holes 24*a* and 24*b* may be arranged at an appropriate angle therebetween so as to optimize the cooling state of the platform.

Accordingly, like the first embodiment, since the portion in the vicinity of the side edge of the platform 5 which is away from the moving blade cooling passageways 17 and is easily influenced by thermal stress of the high-temperature combustion gas, that is, the upper surface of the side edge is effectively cooled, it is possible to improve the cooling performance of the platform 5. Also, since the additional member is not attached to the gas turbine moving blade 1 which rotates at a high speed, it is possible to improve the reliability of the moving blade. Further, since a welding process of the additional member is not carried out, the processes of assembling do not increase, thereby improving the workability of assembling.

Third Embodiment

A third embodiment will be described with reference to FIG. 3.

The same reference numerals are given to the same components as those of the first embodiment, and the description thereof will be omitted. In the third embodiment, as shown in FIG. 3(*b*), an projecting part 43 is formed at a portion where the lower surface of the platform 5 intersects the outer surface of the shank part 7, and cooling communication holes 45, 46, and 47 are formed through the inside of the shank part 7, the platform 5, and the projecting part 43 in a linear shape.

Then, as shown in FIG. 3(*c*), the projecting part 43, in which the cooling communication hole 45 is formed, protrudes in a convex shape. The projecting part 43 and the cooling communication hole 45 are simultaneously formed upon forming the platform 5 and the shank part 7 by casting. The projecting part 43 is formed in a portion having an projection necessary for forming the cooling communication hole 45 so that only the cooling communication hole 45 is formed through the portion.

Additionally, the cooling communication holes 45, 46, and 47 may be formed by machining after forming the blade part 3, the platform 5, and the projecting part 43 by casting.

The cooling communication holes 24*a* and 24*b* may be arranged at an appropriate angle therebetween so as to optimize the cooling state of the platform.

According to the third embodiment, it is possible to cool the side end portion of the platform 5 away from the moving blade cooling passageways 17 in such a manner that the projecting part 43 is formed in only a portion where the cooling communication hole 45 is provided by restricting the weight increase caused by the projecting part 43 to be as small as possible to realize a decrease in weight and the high-pressure cooling air flowing to the moving blade cooling passageways 17 is guided to the portion in the vicinity of the side edge of the platform 5.

The first embodiment, the second embodiment, and the third embodiment may be put into practice in combination with one another. For example, the platform 5 on the concave side 20 may be provided with the projecting part 43 like the third embodiment, and the platform 5 on the convex side 26 may be provided with the platform passageway 31 of which the opening is closed by the plug 28 like the first embodiment. Likewise, when the structures according to the above-described embodiments are put into practice in combination with one another, an appropriate structure is employed in consideration of the workability and the cooling performance in accordance with the position and shape of the moving blade cooling passageways 17*a*, 17*b*, 17*c*, and 17*d* and the cooling portion of the platform 5, thereby improving a design flexibility of the structure for cooling the platform 5.

INDUSTRIAL APPLICABILITY

According to the invention, since the portion in the vicinity of the side edge of the platform which is away from the moving blade cooling passageways and is easily influenced by the thermal stress caused by the high-temperature combustion gas, that is, the upper surface of the side edge is effectively cooled by guiding the high-pressure cooling air, flowing to the moving blade cooling passageways, to the discharge opening formed in the surface of the platform in the vicinity of the side edge of the platform without particularly attaching the additional member such as the cover plate to the platform, it is possible to provide the platform cooling structure for the gas turbine moving blade capable of improving the cooling performance of the platform and of improving the reliability of the moving blade, the platform cooling structure being suitable for the platform of the gas turbine moving blade.

The invention claimed is:

1. A platform cooling structure for a gas turbine moving blade comprising:

a moving blade cooling passageway formed in the inside of a blade part of a gas turbine moving blade so as to circulate cooling air; and a plurality of cooling communication holes, each of which has one end thereof communicating with the moving blade cooling passageway and the other end communicating with a discharge opening formed in an upper surface of a platform, the respective discharge openings being disposed along a side edge of the platform, wherein the plurality of cooling communication holes are respectively formed through from the moving blade cooling passageways to the inside of the platform or formed through the inside of a shank part and the platform.

2. A platform cooling structure for the gas turbine moving blade according to claim 1, wherein each of the cooling communication holes includes a platform passageway which is formed on a side portion of the moving blade in the platform in a linear shape in such a way that one end of the platform passageway communicates with the moving blade cooling passageway and another end communicates with a side end surface of the platform with an opening of the side end surface closed, and at least one discharging passageway formed inclined from the platform passageway toward the discharge opening.

3. A platform cooling structure for the gas turbine moving blade according to claim 1, wherein the moving blade cooling passageway of the shank part is swollen in a direction toward the side edge of the platform, and wherein the cooling communication holes are formed through the inside of the platform and the shank part in a linear shape.

4. A platform cooling structure for the gas turbine moving blade according to claim 1, wherein a projecting part is formed at a portion where a lower surface of the platform intersects an outer surface of the shank part, having a projection necessary for forming the cooling communication hole so that only the cooling communication hole is formed through, and wherein the cooling communication holes are formed through the inside of the shank part, the platform, and the projecting part in a linear shape.

5. A platform cooling structure for the gas turbine moving blade according to claim 4, wherein the projecting part having the cooling communication holes formed therein protrudes in a convex shape, and wherein the projecting part and the cooling communication holes are formed upon forming the platform and the shank part by casting.

6. A platform cooling structure for the gas turbine moving blade according to claim 1, wherein a plurality of rows of the discharge openings is formed in the upper surface of the platform in the vicinity of the side edge of the platform so as to be disposed along the side edge.

* * * * *